US006494773B1

(12) United States Patent
Marchini et al.

(10) Patent No.: US 6,494,773 B1
(45) Date of Patent: Dec. 17, 2002

(54) BORDER PLANING MACHINE FOR WOOD FLOORS

(76) Inventors: Claudio Marchini, Via IV Novembre, 69, 46026 Quistello (IT); Raffaele Migliari, Via Autunno Ravà, 22, 44100 Ferrara (IT); Riccardo Zanchetta, Via Maspiron, 9, 31029 Vittorio Veneto (IT)

( * ) Notice: Subject to any disclaimer, the term of this patent is extended or adjusted under 35 U.S.C. 154(b) by 0 days.

(21) Appl. No.: 09/830,297

(22) PCT Filed: Oct. 28, 1999

(86) PCT No.: PCT/EP99/08202

§ 371 (c)(1),
(2), (4) Date: Apr. 25, 2001

(87) PCT Pub. No.: WO00/25979

PCT Pub. Date: May 11, 2000

(30) Foreign Application Priority Data

Nov. 3, 1998 (IT) ..... MN98A0041

(51) Int. Cl.[7] ..... B24B 23/02

(52) U.S. Cl. ..... 451/353; 451/351; 144/115; 144/117.4; 15/49.1; 15/98; 15/385

(58) Field of Search ..... 451/87, 88, 92, 451/344, 353, 350, 358, 397, 456, 351; 125/12; 51/174, 176, 273, 267; 144/115, 117.4, 118; 15/49.1, 98, 385, 340.2

(56) References Cited

U.S. PATENT DOCUMENTS

| | | | | |
|---|---|---|---|---|
| 3,721,048 A | | 3/1973 | Rand | |
| 4,775,306 A | * | 10/1988 | Kikuchi et al. | 404/112 |
| D341,913 S | * | 11/1993 | Swan | D32/15 |
| 5,363,600 A | * | 11/1994 | Shishido et al. | 451/358 |
| 5,458,532 A | * | 10/1995 | Cannone | 451/350 |
| 5,637,032 A | | 6/1997 | Haakan et al. | |

FOREIGN PATENT DOCUMENTS

| | | |
|---|---|---|
| DE | A-38 15 326 | 11/1989 |
| DE | A-42 19 093 | 8/1993 |
| EP | A-0 216 197 | 4/1987 |

* cited by examiner

*Primary Examiner*—Joseph J. Hail, III
*Assistant Examiner*—Anthony Ojini
(74) *Attorney, Agent, or Firm*—Guido Modiano; Albert Josif; Daniel O'Byrne

(57) ABSTRACT

A border planing machine for wood floors comprising a footing provided with wheels and a handle, a structure which is hinged to the footing so as to rotate about a longitudinal axis and adapted to support abrasive disks on either side with respect to the longitudinal axis and to support elements for moving the disks so that the disks arranged on one side rotate in the opposite direction with respect to the disks arranged on the other side, and levers adapted to determine, following an actuation on the part of the operator, small rotations of the structure with respect to the longitudinal axis, in both directions.

9 Claims, 1 Drawing Sheet

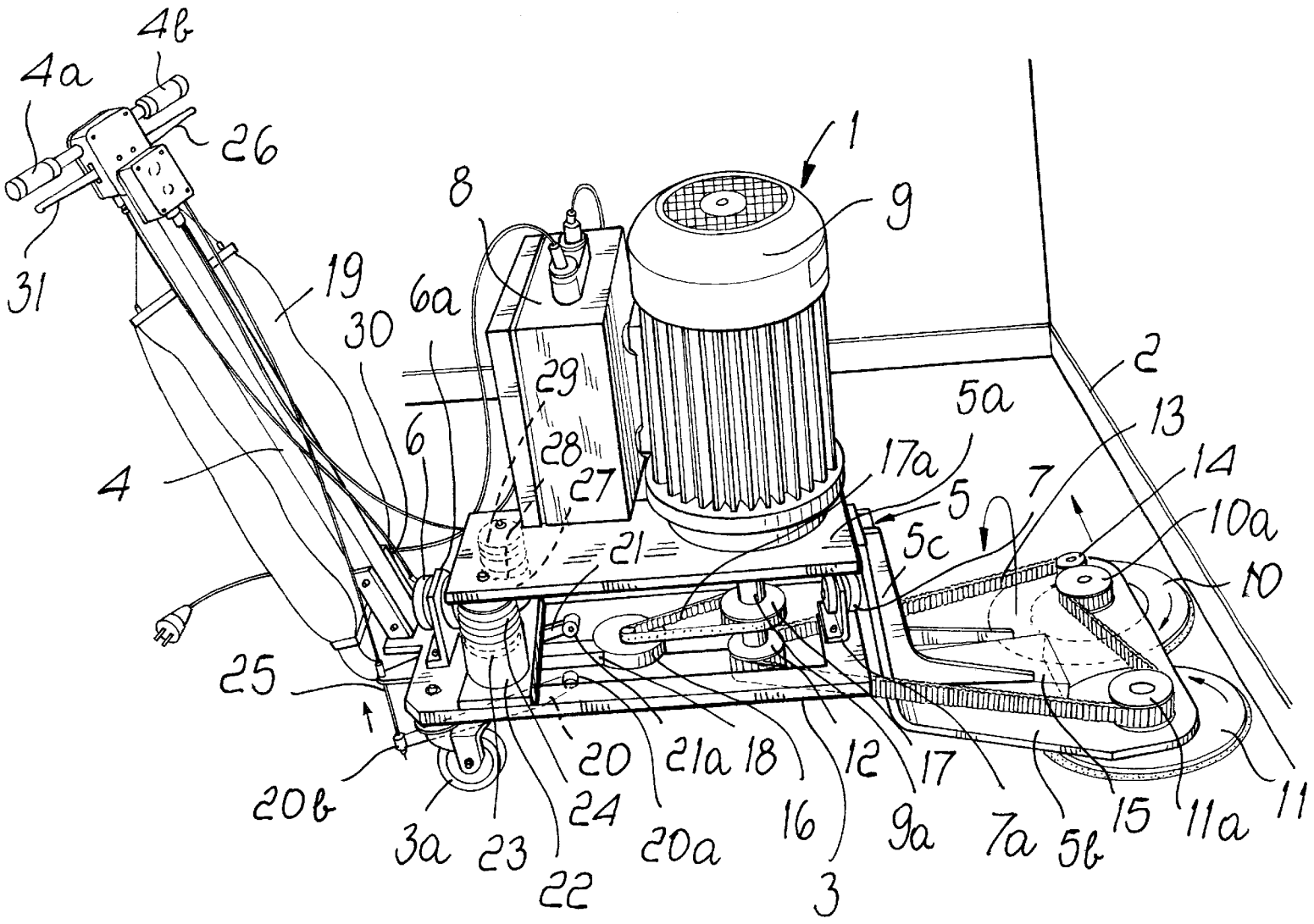
1
2
3
3a
4
4a
4b
5
5a
5b
5c
6
6a
7
7a
8
9
9a
10
10a
11
11a
12
13
14
15
16
17
17a
18
19
20
20a
20b
21
21a
22
23
24
25
26
27
28
29
30
31

BORDER PLANING MACHINE FOR WOOD FLOORS

TECHNICAL FIELD

The present invention relates to a border planing machine for wood floors.

BACKGROUND ART

It is known that planing wood floors entails a step for finishing along the walls that surround the floors; this step is performed with suitable planing machines known as border planing machines.

Border planing machines are currently provided with a single abrasive disk which makes them difficult to control in steering them along the intended paths. Conventional planing machines have a very compact structure with grip handles located close to the floor for the very purpose of reducing the effort required of the user in operating the machine, but this causes the drawback of forcing the operator to assume a very uncomfortable position during work.

Examples of disk grinding machines are available from the prior documents DE-A-38 15 326 and DE-A-42 19 093, none of which however disclosing easy steering improvements.

DISCLOSURE OF THE INVENTION

The aim of the present invention is to provide a border planing machine which can be guided along the intended paths without requiring any effort of the operator and allows him to work while standing and therefore in great comfort.

This aim and other objects, which will become more apparent hereinafter, are achieved by a border planing machine for wood floors, according to the invention, having the features set forth in claim 1.

BRIEF DESCRIPTION OF THE DRAWING

Further characteristics and advantages of the present invention will become apparent from the following detailed description of a preferred but not exclusive embodiment of the invention, illustrated only by way of non-limitative example in the accompanying drawing, wherein the only FIGURE is a perspective view of the invention.

WAYS OF CARRYING OUT THE INVENTION

With reference to the above figure, the reference numeral 1 designates the machine, shown working alone a skirting board 2 which delimits, along ore side, a floor to be planed.

The machine comprises a footing 3, which is shaped like a substantially rectangular plate provided with ground resting wheels such as 3*a* and with a handle 4 which is monolithically connected and has such a length as to allow an operator to grip knobs 4*a* and 4*b* while remaining in an upright position.

The reference numeral 5 designates a structure formed by platforms 5*a* and 5*b*, which are monolithically connected by means of a rib-reinforced extension 5*c* of platform 5*b*; the structure 5 is hinged to the footing 3 by means of rotating supports 6 and 7 associated with L-shaped elements 6*a* and 7*a* which are fixed to the footing 3 so as to allow rotation about a longitudinal axis.

Platform 5*a* supports, in addition to the cabinet 8 for containing electrical devices, an electric motor 9, which drives abrasive disks 10 and 11, which are supported by the platform 5*b* on opposite sides with respect to the longitudinal axis of rotation of the structure 5 by means of a kinematic chain which comprises a pulley 12, which is keyed to an output shaft 9*a* of the motor 9 and operates in combination with a toothed belt 13, which makes contact with the pulleys 10*a*, 11*a* which are rigidly coupled to the abrasive disks 10, 11, and with a guiding pulley 14, so as to make the disks rotate in opposite directions, as shown by the arrows in the figure.

The planing machine according to the invention is provided with a device for aspirating the dust generated during work; the device comprises a suction inlet 15, which is located proximate to the floor in the region of tangency of the disks 10 and 11 and is connected to a suction impeller 16, driven by means of a belt 17*a* by a pulley 17 which is keyed to the shaft 9*a*, and conveys the dust to a bag 19 by means of a duct 18.

The planing machine 1 comprises means for producing, following an actuation on the part of the operator, small rotations of the structure 5 in either direction with respect to the longitudinal pivoting axis of the structure by means of the rotating supports 6 and 7 on the footing 3.

Such means comprise a terminal portion which is in contact with the structure 5 and comprises two main levers 20 and 21, which are pivoted at ends thereof 20*a*, 21*a* to the footing 3 and are arranged symmetrically on opposite sides with respect to the longitudinal axis of rotation of the structure 5.

The main lever 20 is provided, at an intermediate position, with a stem 22, which reaches an abutment plate 23 of a spring 24 which is interposed between the plate and the platform 5*a* of the structure 5, and is connected, at an end 20*b*, to a cable 25 which reaches a secondary lever 26 located proximate to the knob 4*b*.

Likewise, the main lever 21 is provided, at an intermediate position, with a stem 27, which reaches an abutment plate 28 of a spring 29 interposed between the plate and the platform 5*a*, and is connected, at the end not shown in the figure, to a cable 30 which reaches a secondary lever 31 located proximate to the knob 4*a*.

It can be noted that the secondary levers 26 and 31 form a terminal portion which is meant to be handled by the operator of the means suitable to produce rotations of the structure 5.

The described planing machine is of course provided with a suitable housing.

If the operator does not actuate the secondary levers 26 and 31 in any way, the planing machine is perfectly balanced and works in place without the operator having to make efforts to regain it.

If the operator wishes to move the machine along the skirting board 2 in the direction of the arrow shown in the figure, he merely needs to operate the secondary lever 26 in the direction of the arrow, applying to the cable 25 a traction, as shown by the arrow, which causes the upward rotation of the main lever 20.

This produces an upward thrust which is applied by the spring 26 to the platform 5*a*, causing the rotation of the structure 5 in the direction of the arrow shown above the platform 5*b*, with a consequent increase in the pressure on the floor of the abrasive disk 10 and a reduction of the pressure applied by the abrasive disk 11, causing the translatory motion of the machine in the chosen direction.

Obviously an actuation of the secondary lever 31 would cause the movement of the machine in the opposite direction with respect to the one indicated by the arrow, and it is evident that the movements of the machine also can be performed without requiring any effort on the part of the operator.

A planing machine has thus been provided which allows very gentle handling, thus allowing optimum working conditions for the operator and an arrangement of the grip knobs at the end of the handle at such a height as to allow the operator to remain in a comfortable upright position.

The described invention is susceptible of numerous modifications and variations, all of which are within the scope of the inventive concept; all the details may also be replaced with other technically equivalent elements.

The disclosures in Italian Patent Application No. MN98A000041 from which this application claims priority are incorporated herein by reference.

What is claimed is:

1. A border planing machine for wood floors, comprising:

a footing provided with wheels for resting on a floor and with a handle adapted to be gripped by an operator;

a structure which is hinged to the footing so as to be rotatable about a longitudinal axis of the footing;

abrasive disks supported at said structure so as to rotate about respective axes thereof;

rotation moving means, supported at said structure, for rotating said disks; and actuation means for actuating, upon intervention of the operator, said structure to perform small rotations, with respect to said longitudinal axis in two opposite directions, wherein said disks are evenly distributed on either side with respect to said longitudinal axis, with disks being arranged on a first side rotating in an opposite direction with respect to disks arranged on a second side of said longitudinal axis; and said actuation means include: a first terminal portion being in contact with said structure to determine said small rotations thereof; and a second terminal portion adapted to be managed by the operator, said first and second terminal portions being operatively interconnected so that upon selective actuation of said second terminal portion by the operator, said first terminal portion causes rotation of said structure in a direction or in the opposite one to increase pressure exerted on the floor by the disks on the first side and, simultaneously, to reduce pressure exerted on the floor by said disks on the second side of the longitudinal axis, with consequent changing of a working configuration of the machine from a balanced one to a steering one.

2. The planning machine of claim 1, wherein the handle has a length such as to allow gripping thereof by the operator in an upright position.

3. The planing machine of claim 1, wherein said structure hinged to the footing comprises: a first platform located above said footing and adapted to support said rotation moving means, which is constituted by an electric motor for actuating said abrasive disks; and a second platform for supporting said abrasive disks, which is monolithically connected to said first platform and protrudes forward with respect to said footing.

4. The planing machine of claim 3, wherein said rotation working means for actuating the abrasive disks, supported by said first platform which lies above the footing, comprise: an output shaft, which is directed toward said footing; a pulley provided on said output shaft; further pulleys which are rigidly coupled to said abrasive disks; a toothed belt mating with said pulley and being in driving engagement with said further pulleys.

5. The planing machine of claim 1, further comprising a suction system for aspirating dust generated during work.

6. The planing machine of claim 5, wherein said abrasive disks are constitutes by two abrasive disks, one on each side with respect to the longitudinal axis of the supporting structure, said disks rotating in opposite directions, so that when viewed from above, the disk on the right turns counterclockwise, and the disk on the left turns clockwise, said dust suction system being provided with a suction inlet, which is located proximate to the floor in the region of tangency of said disks with a containment bag, and with a suction impeller which is adapted to convey the aspirated dust into the containment bag supported on said planing machine, said suction inlet being connected to said suction impeller.

7. The planning machine of claim 6, further comprising a further belt for actuating said suction impeller; and a pulley keyed on said output shaft for driving said further belt.

8. The planing machine of claim 7, comprising L-shaped elements, which are fixed to said footing; rotating supports associated with said L-shaped elements; and a pivoting axis at which said structure is hinged to said footing through said rotating supports.

9. The planing machine of claim 7, comprising: helical springs interposed between said plate and the surface of said first platform that faces the footing and having respective abutment plates; respective stems connected each to a said abutment plate; said first terminal portion comprising two main levers, which are arranged symmetrically on opposite sides with respect to said pivoting axis, and said second terminal portions comprising two secondary levers, each one of said main levers being pivoted to the footing at one end, and being provided at an intermediate position with a respective one of said stems; connecting cables; and handle grip knobs, said main levers being further connected, at the other end thereof, to a respective one of said cables reaching each a respective one of said secondary levers, the two secondary levers being further operatively connected to said two main levers, and being located each proximate to a respective one of said handle grip knobs at an upper end of the handle.

* * * * *